US010103446B2

(12) United States Patent
Lettow et al.

(10) Patent No.: US 10,103,446 B2
(45) Date of Patent: Oct. 16, 2018

(54) GRAPHENE-BASED ROTMAN LENS

(71) Applicant: VORBECK MATERIALS CORP., Jessup, MD (US)

(72) Inventors: John S Lettow, Washington, DC (US); Sriram Manivanna, Baltimore, MD (US); Larry Hurzon, Alexandria, VA (US); Trentice V Bolar, Washington, DC (US)

( * ) Notice: Subject to any disclaimer, the term of this patent is extended or adjusted under 35 U.S.C. 154(b) by 0 days.

(21) Appl. No.: 15/062,974

(22) Filed: Mar. 7, 2016

(65) Prior Publication Data

US 2017/0256862 A1 Sep. 7, 2017

Related U.S. Application Data

(60) Provisional application No. 62/101,350, filed on Jan. 8, 2015.

(51) Int. Cl.
*H01Q 15/08* (2006.01)
*H01Q 25/00* (2006.01)

(52) U.S. Cl.
CPC ..... *H01Q 15/08* (2013.01); *H01Q 25/008* (2013.01)

(58) Field of Classification Search
CPC ..... H01Q 15/08; H01Q 1/38; H01Q 15/0086
USPC ..... 343/753
See application file for complete search history.

(56) References Cited

U.S. PATENT DOCUMENTS 4,490,723 A 12/1984 Hardie
2013/0194052 A1* 8/2013 Zaghloul ..... H01Q 25/008 333/1

FOREIGN PATENT DOCUMENTS

EP 0963006 B1 3/2006

OTHER PUBLICATIONS

Behzad Ashrafi Nia, Leila Yousefi, Member, IEEE, and Mahmoud Shahabadi, Senior Member, IEEE Integrated Optical-Phased Array Nanoantenna System Using a Plasmonic Rotman Lens, (Journal of Lightwave Technology, pp. 2118-2126, vol. 34, No. 9, May 1, 2016).*

Nia B.A., Integrated Optical-Phased Array Nanoantenna System Using a Plasmonic Rotman Lens, J. Lightwave Tech., Jan 22. 2016, 2118-2126, 34(9).

* cited by examiner

*Primary Examiner* — Andrea Lindgren Baltzell
(74) *Attorney, Agent, or Firm* — Trentice V. Bolar, Esq.

(57) ABSTRACT

Embodiments of the present invention relate to graphene-based Rotman lenses. In an embodiment, a lens is formed on a surface of a dielectric plate. The lens comprises a composition having individual sheets of graphene. The lens includes a plurality of first transmission lines extending from a first lens contour and a plurality of second transmission lines extending from a second lens contour. The plurality of first transmission lines each terminate at a first port. The plurality of second transmission lines each terminate at a second port. The first contour and the second contour are positioned opposite each other. The first port and/or the second port has a width of λ/2 or less. The individual graphene sheets form a three-dimensional interconnected network within the composition.

20 Claims, 6 Drawing Sheets

GRAPHENE-BASED ROTMAN LENS

CROSS-REFERENCE TO RELATED APPLICATIONS

This application claims priority to U.S. Provisional Application No. 62/101,350 filed Jan. 8, 2015.

BACKGROUND

The present invention relates generally to electromagnetic signal arrays and specifically to devices for receiving and transmitting electromagnetic signals. Rotman lenses are a type of beam forming network that utilize a linear or slightly conformal antenna array that feeds the lens. Rotman lenses can utilize antenna arrays connected to the lens network to accomplish discrete transmission and reception. Rotman lenses may be utilized as a passive or active beamforming network. Rotman lenses can detect targets or signals in multiple directions due to their multibeam capability, which does not require physically moving the antenna system. Rotman lenses may be utilized in electronic countermeasure and communication systems.

DETAILED DESCRIPTION

Figure 1:
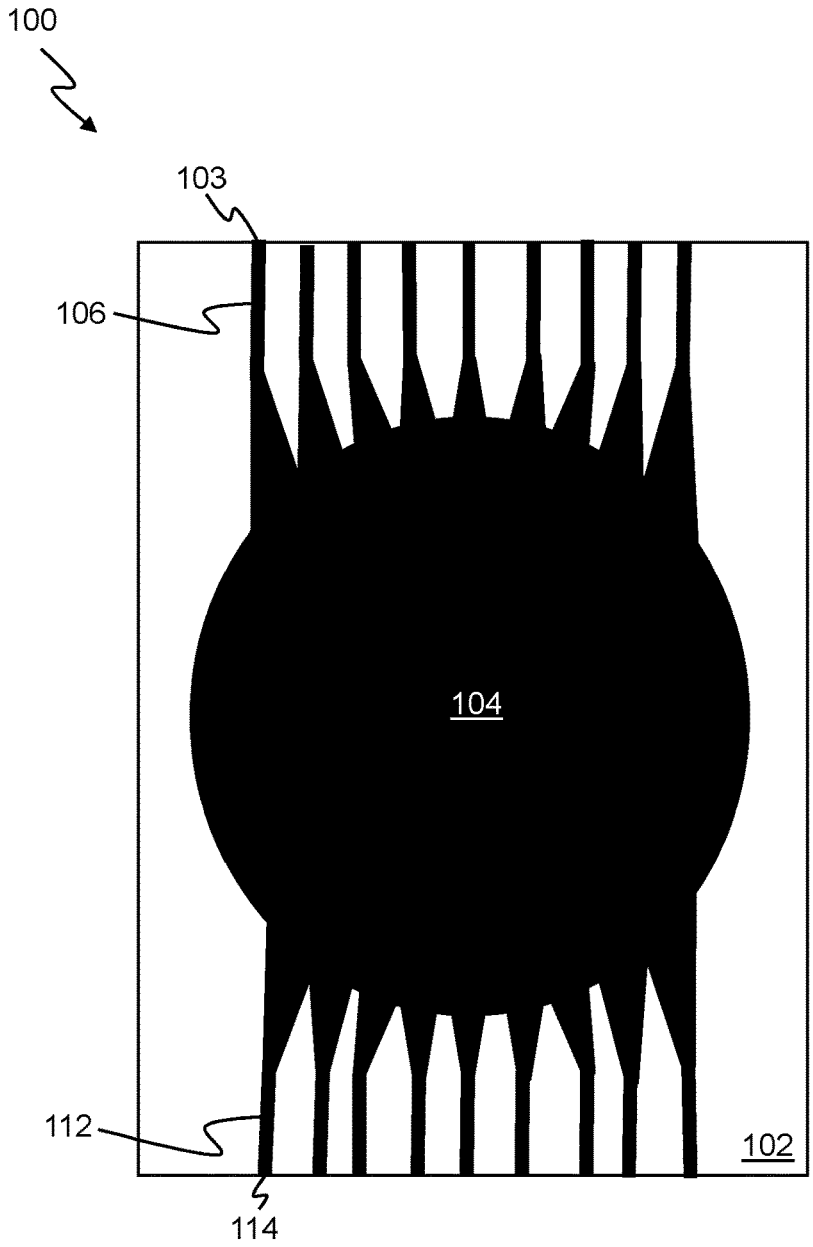
FIG. 1 depicts a top schematic view of a beam-forming network, generally 100, in accordance with an embodiment of the present invention.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Certain terminology may be employed in the following description for convenience rather than for any limiting purpose. For example, the terms "forward" and "rearward," "front" and "rear," "right" and "left," "upper" and "lower," and "top" and "bottom" designate directions in the drawings to which reference is made, with the terms "inward," "inner," "interior," or "inboard" and "outward," "outer," "exterior," or "outboard" referring, respectively, to directions toward and away from the center of the referenced element, the terms "radial" or "horizontal" and "axial" or "vertical" referring, respectively, to directions or planes which are perpendicular, in the case of radial or horizontal, or parallel, in the case of axial or vertical, to the longitudinal central axis of the referenced element, and the terms "downstream" and "upstream" referring, respectively, to directions in and opposite that of fluid flow. Terminology of similar import other than the words specifically mentioned above likewise is to be considered as being used for purposes of convenience rather than in any limiting sense.

Rotman lenses are a type of beam forming network that utilize a linear or slightly conformal antenna array that feeds the lens. Rotman lens designs are typically governed by the Rotman-Turner design equations. Rotman lenses can utilize antenna arrays connected to the lens network to accomplish discrete transmission and reception. Rotman lenses may be utilized as a passive or active beamforming network. Rotman lenses can be utilized in radar surveillance systems, electronic countermeasure systems, or communication systems. Rotman lenses can detect targets in multiple directions due to their multibeam capability without physically moving the antenna system. For radar systems, Rotman lens provide the capability to see multiple targets in multiple directions without physically moving the antenna system due to the lens' multibeam capability.

Rotman lenses typically comprise material having dielectric constants greater than 38 and gold plated on copper to form the beam forming network. Rotman lenses of the present invention utilize graphene as an alternative electrical conductor, which facilitates construction of Rotman lenses using printed electronics methods. Rotman lenses of the present invention can comprise microstrip or stripline lenses. Rotman lenses of the present invention can comprise any number of elements and/or beams. Rotman lenses of the present invention can be formed in a manner to operate at any scan angle.

Rotman lenses can be utilized in electronic countermeasure and communication systems. Microwave lens beamforming networks ("BFN"), such as the Rotman lens, can utilize a path delay mechanism to form desired phase fonts at array inputs. Each array input may be in communication with a beam port that can radiate a semicircular phase front within the lens structure. An array of receiving elements can function as transmitters or receivers that guide the energy to an antenna array. Current solutions include, for example, common microwave dielectrics that utilize conventional one ounce copper clad deposition of conductors.

Embodiments of the present invention seek to provide graphene-based beam forming networks for transmitting and receiving electromagnetic signals. FIG. 1 depicts a top schematic view of a beam-forming network ("BFN"), generally 100, in accordance with an embodiment of the present invention. BFN 100 can be a Rotman lens. BFN 100 comprises plate 102, which is a substantially flat structure. BFN 100 may comprise one or more dielectric materials. Applicable dielectric material includes, but is not limited to, $PbMgNbO_3$, $PbTiO_3$, $BaSrTiO_3$, $TiO_2$, $Ta_2O_5$, $CeO_2$, $BaZrTiO_3$, $Al_2O_3$, $BzF_2$, $CaF_2$, $SrF_2$, $SiO_2$, $Si_3N_4$, $Al_2O_3$, $Y_2O_3$, $La_2O_3$, $Ta_2O_5$, $TiO_2$, $HfO_2$, GaAs, glass, and/or $ZrO_2$. BFN 100 further comprises region 104.

Region 104 may be formed on a surface of plate 102 in a predetermined pattern. Applicable predetermined patterns may include, but are not limited to, symmetrical or non-symmetrical patterns. Region 104 can have two or more peripheral sides that are identical and/or symmetrical with respect to a symmetry plane. Region 104 can comprise of electrically conductive compositions ("the composition"). The composition can include one or more conductive materials including, but not limited to, individual graphene sheets, graphite, conductive carbons, and/or conductive polymers (discussed further below).

The composition can be derived as disclosed in U.S. Pat. No. 7,658,901 B2 by Prud'Homme et al, United States patent application 2011/0189452 A1 by Lettow et al., McAllister et al. (*Chem. Mater.* 2007, 19, 4396-4404), United States patent application 2014/0050903 A1 by Lettow et al., and U.S. Pat. No. 8,278,757 B2 by Crain et al, which are hereby incorporated by reference in their entirety. Region 104 comprises a plurality of transmission lines 106 and 112 extending from opposite contours of its periphery. Each copy of transmission lines 112 is in electrical communication with a particular copy of port 114. Each copy of transmission line 106 is in electrical communication with a particular copy of port 103.

The plurality of ports 103 can be antenna array ports (discussed further below). Ports 103 are formed in a manner to connect to microwave antenna elements, such as horns, broadband dipoles, and/or Vivaldi antenna. Ports 114 can be beam ports (discussed further below). Ports 114 are formed in a manner to connect to transmission/receiving signal processing sources. Ports can have width of up to $\lambda/2$. Excitation of two or more side-by-side copies of ports 114 can result in an increase in the effective port width. Generally, the distance between adjacent ports is limited by the presence of sidelobes inside the body of the lens. Port spacing beyond $\lambda/2$ cause the antenna ports to direct a portion of the energy towards the, sidewalls of the lens, antenna ports, or beam ports. This reduces efficiency, increases mutual coupling between beam ports, and increases sidelobe levels. Ports are designed for the highest operating frequency, and spaced less than half a wavelength apart.

BFN 100 utilizes a path-length mechanism that is typically independent of frequency. BFN 100 comprises an antenna array having N number of antenna elements that can receive (or transmit) a radio-frequency ("RF") signal from (or to) a particular direction. Influenced by the geometry of the antenna array, the impinging RF signal typically reaches the individual antenna elements at different instances of time, which can cause phase shifts between the different received signals. Subsequently, the beam patterns of the antenna array can be steered in desired directions and undesired directions can be suppressed.

Figure 2:
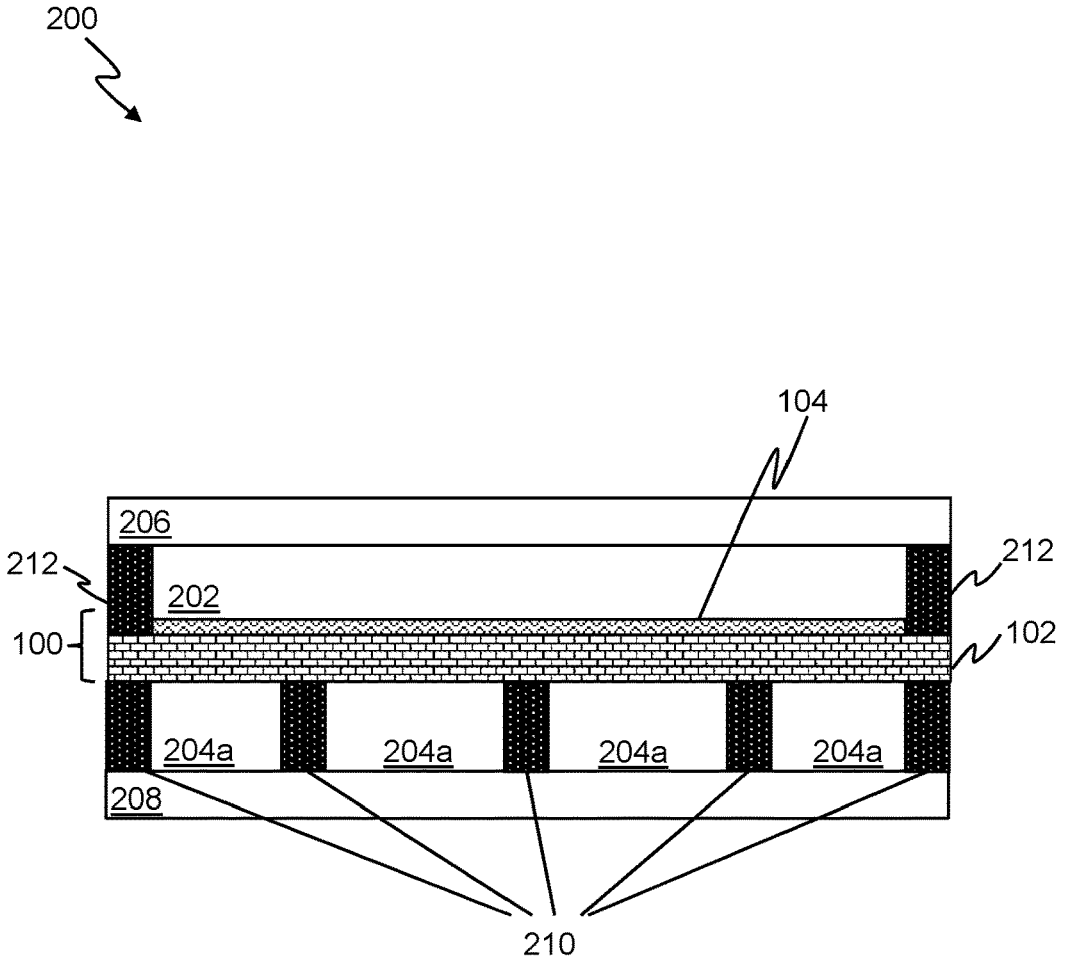
FIG. 2 illustrates a side view of an apparatus, generally 200, in accordance with an embodiment of the present invention.

FIG. 2 illustrates a schematic of a side view of an apparatus, generally 200, in accordance with an embodiment of the present invention. Apparatus 200 comprises BFN 100. Spacers 212 are formed on the non-port side of plate 102, which is the side wherein plate 102 and region 104 are positioned. Spacers 210 can be formed on the bottom surface of plate 102 in a manner to form void 204 with plate 208. Spacers 210 and/or 212 can be three-dimensionally printed. Spacers 212 and/or 210 may comprise insulating material. Applicable insulating materials can include, but are not limited to, polystyrene, polyethylene, neoprene, acrylic, acrylonitrile butadiene styrene, nylon, polybenzimidazole, polypropylene, polyvinyl chloride, polymer polytetrafluoroethylene, a fluoropolymers. Plate 206 is positioned to be in communication with spacers 212 and thereby form void 202. Plate 206 and/or plate 208 can comprise a metal. Voids 202, 204 can include air, inert gas, or an insulating material, for example, the aforementioned insulating material. In certain embodiments, spacers 210 and/or 212 are not present and support for plates 206 and/or 208 is provided by voids 202 and/or 204, respectively.

Figure 3:
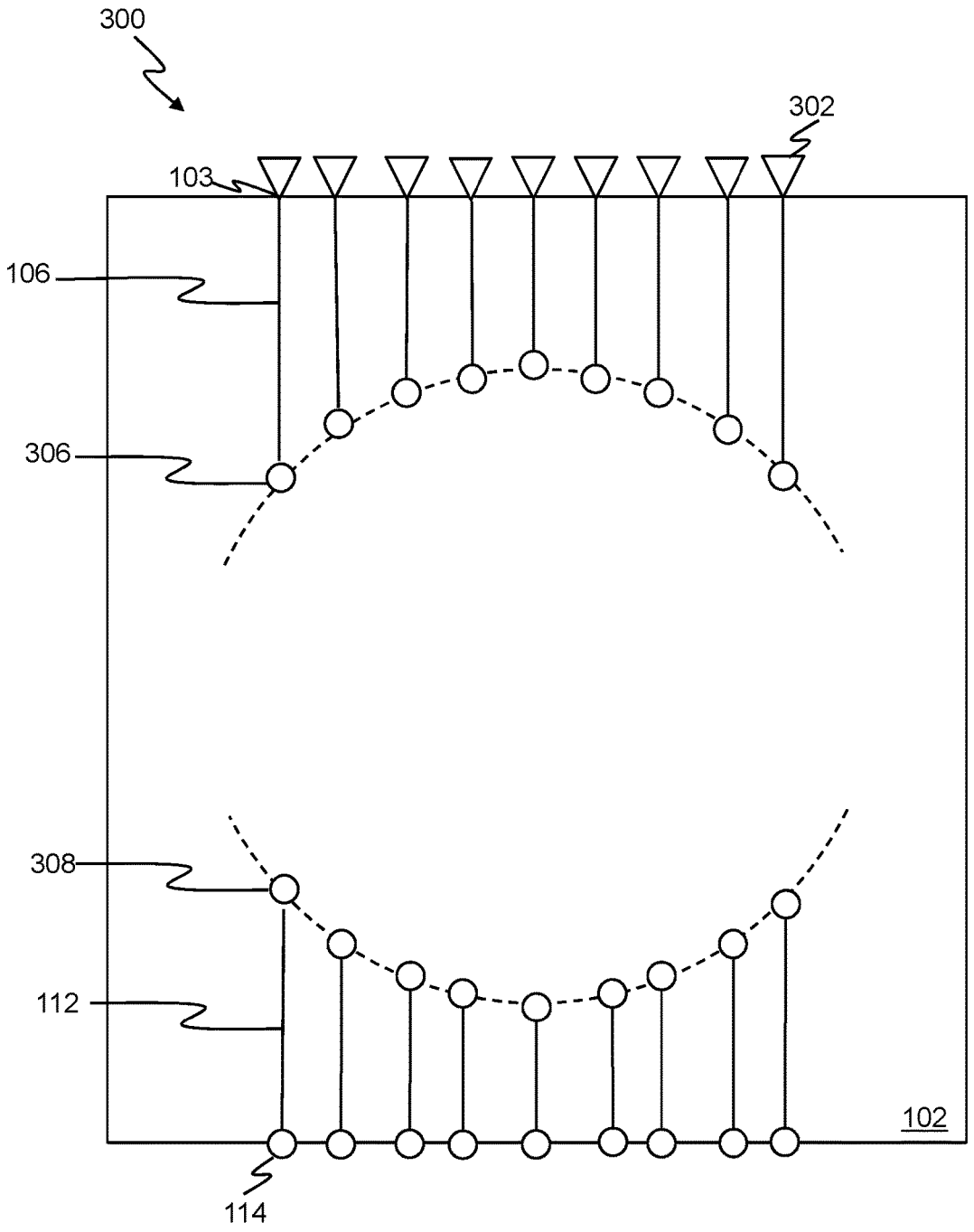
FIG. 3 illustrates a top schematic view of an apparatus, generally 300, in accordance with an embodiment of the present invention.

FIG. 3 illustrates a top schematic view of an apparatus, generally 300, in accordance with an embodiment of the present invention. Apparatus 300 can be a Rotman lens that transmits and receives electromagnetic signals. Apparatus 300 includes plate 102. Apparatus 300 can include a plurality of transmission lines 106 and 112. Each transmission line 106 includes a first end 306 and a second end 103. Each first end 306 may be coupled to a transmission line (discussed above). Each second end 103 may be coupled to an antenna element. The number of transmission lines 106 and 112 reflects the number of elements that are included in antenna array 302 and ports 114, respectively. Transmission lines 106 are positioned opposite to transmission lines 112 in a similar orientation. Each copy of transmission lines 106 is the same length of a particular copy of transmission line 112.

Antenna array 302 includes a plurality of antenna elements. Antenna array 302 may include printed circuit elements, microstrip patches, dipoles, Vivaldi and/or horns. The printed antenna elements of antenna array 302 may comprise the composition. The plurality of transmission lines 106 vary in length in a manner to allow its combination with additional elements of apparatus 300 to generate a phase front across antenna array 302 to radiate a beam in a direction associated with the beam position as defined by input originating in one or more of ports 114. Each first end 308 is coupled to a copy of transmission line 112.

The plurality of antenna elements included in antenna array 302 can receive and/or transmit a radio frequency ("RF") signal from and/or to a particular direction, respectively. Influenced by the geometry of antenna array 302, the impinging RF signal may reach individuals antenna elements at different instances of time, which can result in phase shifts between the different received signals. Subsequently, the beam patterns of the antenna array can be steered to a particular transmission line 112 and undesired directions can be suppressed. Although not depicted, apparatus 300 may include a plurality of dummy ports positioned along each side of plate 103 that can absorb lens spillover and thus reduce multiple reflections and/or standing waves that can deteriorate performance of apparatus 300. Dummy ports may be positioned in a manner to addressing radiation from antenna ports and/or beam ports. For example, dummy ports may be positioned in a manner that energy not absorbed by the dummy ports is not directed back onto antenna or beam ports. First ends 306 and 308 are formed along a first and second contour line, respectively, wherein the first and second contour lines are positioned opposite each other. First and second contour lines can be symmetrical or asymmetrical relative to each other. First ends 306 and/or 308 can comprise similar suitable antenna elements.

Figure 4:
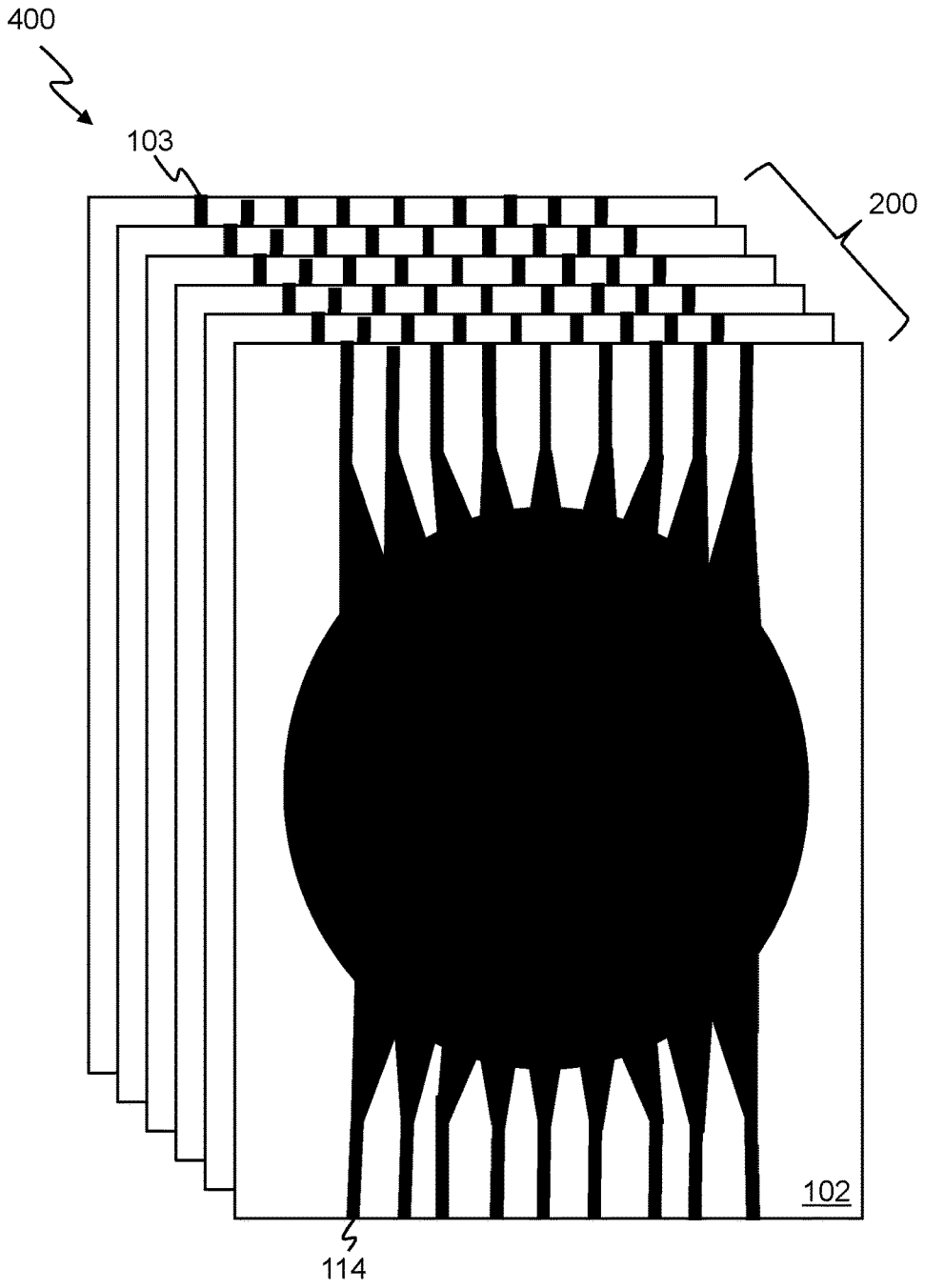
FIG. 4 depicts a device, generally 400, in accordance with an embodiment of the present invention.
Figure 5:
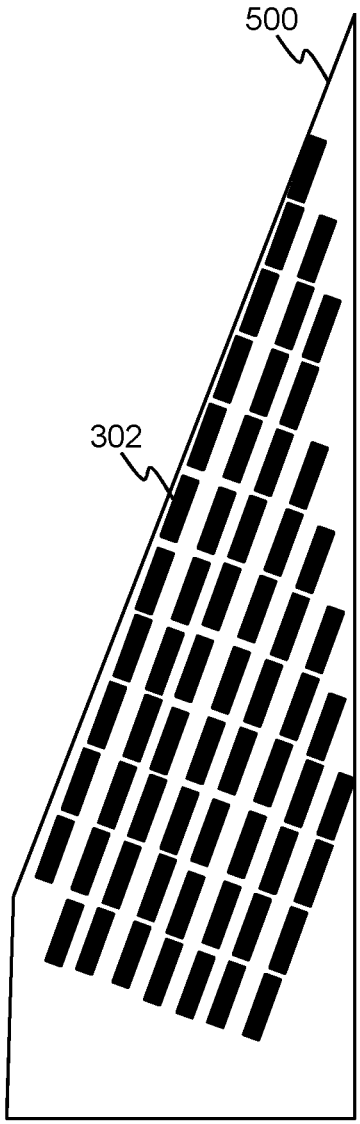
FIG. 5 depicts the top view of an object, generally 500, in accordance with an embodiment of the present invention.

Antenna array 302 can include graphene-based printed antenna. Antenna array 302 can include antenna elements that are sprayed on a dielectric surface. Antenna elements included in antenna array 302 may comprise the composition (discussed above). Antenna elements included in antenna array 302 may be fabricated using materials and/or methods disclosed in the above mentioned references. FIG. 4 depicts a device, generally 400, in accordance with an embodiment of the current invention. Device 400 includes a plurality of copies of apparatus 200 that are arranged in a stack, wherein plates 206 and 208 as well as voids 202 and/or 204 have been removed from each copy to aid viewing. Each copy of apparatus 200 is in communication with a separate copy of antenna array 302 via ports 103 (not shown). Each copy of apparatus 200 is in communication with a radio frequency source via ports 114. Device 400 can be utilized in situations where multi-directional and/or multi-angular beam scanning is desired. Since the antenna elements disclosed herein may be printed using graphene, they are lightweight and can be applied in a conformal manner to variety of planar and non-planar objects. FIG. 5 depicts the top view of an object, generally 500, in accordance with an embodiment of the present invention. Object 500 is a portion of a three-dimensional object, such as an air craft wing, wherein multiple copies of antenna array 302 antenna elements are attached on the surface thereof to achieve multi-directional and/or multi-angular beam scanning. Antenna array 302 can be affixed to at least a portion of a plurality of vehicles as well as stationary and/or mobile objects, including but not limited to, aquatic vehicles, aerial vehicles, light-than-air vehicles, terrestrial vehicles, unmanned vehicles, manned vehicles, buildings, walls, motor cycles, cars, tanks, trucks, kites, and poles. Each row or column of antenna elements can be associated with a particular copy of apparatus 200. Although depicted as an aircraft wing, one or more copies of antenna array 302 can be affixed to any stationary or mobile object. The number of antenna elements that are affixed to an object can be tailored for each desired situation or desired field of view and may require additional or less elements than depicted. Individual antenna elements can be affixed to the surface of an object using any configuration that can achieve the desired results. Although the plurality of copies of antenna array 302 are depicted as having rectangular shapes antenna elements, the antenna elements can have any shape that can achieve the desired results. Antennas fabricated using printing methods and graphene disclosed herein are easier to produce compared to traditional antenna fabrication methods using traditional materials.

Figure 6:
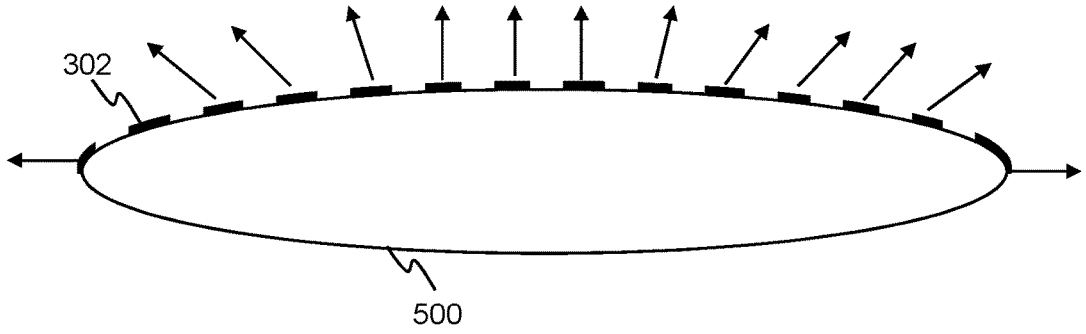
FIG. 6 depicts a side cut through view of object 500, in accordance with an embodiment of the present invention.

FIG. 6 depicts a side cut through view of object 500, in accordance with an embodiment of the present invention. Specifically, FIG. 6 is a cross-sectional side view of object 500 having a plurality of antenna array 302 antenna elements affixed to the upper surface thereof. Antenna elements can be affixed to any surface of an object, such as object 500, to achieve the desired results (field of view, scan angle). Arrows emanating antenna array 302 illustrate the general view/scan angle and/or direction scanned by each antenna element. Although not depicted, when affixed to a surface, antenna array 302 can be substantially flat (i.e. non-curved) and need not conform to the surface angle of the object. Curvature of one or more antenna elements included in antenna array 302 can retard the desired performance thereof by shifting the view/scan angle thereof.

As various modifications could be made in the constructions and methods herein described and illustrated without departing from the scope of the invention, it is intended that all matter contained in the foregoing description or shown in the accompanying drawings shall be interpreted as illustrative rather than limiting. Thus the breadth and scope of the present invention should not be limited by any of the above-described exemplary embodiments, but should be defined only in accordance with the following claims appended hereto and their equivalents.

What is claimed is:

1. A graphene-based Rotman lens comprising:

a lens formed on a surface of a dielectric plate;

wherein the lens comprises a composition having individual sheets of graphene;

wherein the lens includes a plurality of first transmission lines extending from a first lens contour and a plurality of second transmission lines extending from a second lens contour;

wherein the plurality of first transmission lines each terminate at a first port;

wherein the plurality of second transmission lines each terminate at a second port; and wherein the first contour and the second contour are positioned opposite each other.

2. The graphene-based Rotman lens of claim 1, wherein the first port and/or the second port has a width of $\lambda/2$ or less.

3. The graphene-based Rotman lens of claim 1, wherein the individual graphene sheets form a three-dimensional interconnected network within the composition.

4. The graphene-based Rotman lens of claim 1, further comprising a top metal plate and a bottom metal plate, where the top metal plate is affixed to a top surface of the dielectric plate via a first spacer and the bottom metal plate is affixed to a bottom surface of the dielectric plate via a second spacer, and wherein the first spacer and/or the second spacer comprises dielectric insulating material.

5. The graphene-based Rotman lens of claim 1, wherein the dielectric plate comprises $PbMgNbO_3$, $PbTiO_3$, $BaSrTiO_3$, $TiO_2$, $Ta_2O_5$, $CeO_2$, $BaZrTiO_3$, $Al_2O_3$, $BzF_2$, $CaF_2$, $SrF_2$, $SiO_2$, $Si_3N_4$, $Al_2O_3$, $Y_2O_3$, $La_2O_3$, $Ta_2O_5$, $TiO_2$, $HfO_2$, GaAs, glass, and/or $ZrO_2$.

6. The graphene-based Rotman lens of claim 4, wherein in the top plate and/or bottom plate comprises copper, tin, carbon, silver, gold, aluminum, calcium, tungsten, zinc, nickel, lithium, iron, platinum, steel, lead, titanium, manganin, constantan, mercury, nichrome, germanium, a base metal, a ferrous metal, a precious metal, a noble metal and/or an alloy.

7. The graphene-based Rotman lens of claim 4, wherein the first spacer and/or the second spacer comprises a polystyrene, polyethylene, neoprene, acrylic, acrylonitrile butadiene styrene, nylon, polybenzimidazole, polypropylene, polyvinyl chloride, polymer polytetrafluoroethylene, a fluoropolymers.

8. The graphene-based Rotman lens of claim 1, wherein the individual sheets of graphene have a carbon-to-oxygen ratio of at least 100:1.

9. The graphene-based Rotman lens of claim 1, wherein the first port or second port is in electrical communication with an antenna, and wherein the antenna comprises the composition.

10. The graphene-based Rotman lens of claim 1, wherein the composition is printed on to the surface.

11. A method for forming a graphene-based Rotman lens comprising:

forming a lens on a surface of a dielectric plate;

wherein the lens comprises a composition having individual sheets of graphene;

wherein the lens includes a plurality of first transmission lines extending from a first lens contour and a plurality of second transmission lines extending from a second lens contour;

wherein the plurality of first transmission lines each terminate at a first port;

wherein the plurality of second transmission lines each terminate at a second port; and wherein the first contour and the second contour are positioned opposite each other.

12. The method of claim 11, wherein the first port and/or the second port has a width of $\lambda/2$ or less.

13. The method of claim 11, wherein the individual graphene sheets form a three-dimensional interconnected network within the composition.

14. The method of claim 11, further comprising a top metal plate and a bottom metal plate, where the top metal plate is affixed to a top surface of the dielectric plate via a first spacer and the bottom metal plate is affixed to a bottom surface of the dielectric plate via a second spacer, and wherein the first spacer and/or the second spacer comprises dielectric insulating material.

15. The method of claim 11, wherein the dielectric plate comprises $PbMgNbO_3$, $PbTiO_3$, $BaSrTiO_3$, $TiO_2$, $Ta_2O_5$, $CeO_2$, $BaZrTiO_3$, $Al_2O_3$, $BzF_2$, $CaF_2$, $SrF_2$, $SiO_2$, $Si_3N_4$, $Al_2O_3$, $Y_2O_3$, $La_2O_3$, $Ta_2O_5$, $TiO_2$, $HfO_2$, GaAs, glass, and/or $ZrO_2$.

16. The method of claim 14, wherein in the top plate and/or bottom plate comprises copper, tin, carbon, silver, gold, aluminum, calcium, tungsten, zinc, nickel, lithium, iron, platinum, steel, lead, titanium, manganin, constantan, mercury, nichrome, germanium, a base metal, a ferrous metal, a precious metal, a noble metal and/or an alloy.

17. The method of claim 14, wherein the first spacer and/or the second spacer comprises a polystyrene, polyethylene, neoprene, acrylic, acrylonitrile butadiene styrene, nylon, polybenzimidazole, polypropylene, polyvinyl chloride, polymer polytetrafluoroethylene, a fluoropolymers.

18. The method of claim 11, wherein the individual sheets of graphene have a carbon-to-oxygen ratio of at least 100:1.

19. The method of claim 11, wherein the first port or second port is in electrical communication with an antenna, and wherein the antenna comprises the composition.

20. The method of claim 11, wherein the step of forming the lens on the surface comprises printing the composition on to the surface.

* * * * *